US007371196B2

(12) United States Patent
Morrow et al.

(10) Patent No.: US 7,371,196 B2
(45) Date of Patent: May 13, 2008

(54) LACROSSE HANDLE

(75) Inventors: David Morrow, Metamora, MI (US); Andrew Maliszewski, Dearborn Heights, MI (US)

(73) Assignee: Warrior Sports, Inc., Warren, MI (US)

( * ) Notice: Subject to any disclaimer, the term of this patent is extended or adjusted under 35 U.S.C. 154(b) by 244 days.

(21) Appl. No.: 11/160,147

(22) Filed: Jun. 10, 2005

(65) Prior Publication Data

US 2005/0277495 A1 Dec. 15, 2005

Related U.S. Application Data

(60) Provisional application No. 60/578,488, filed on Jun. 10, 2004.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS

| | | | | |
|---|---|---|---|---|
| D5,178 | S * | 8/1871 | Gould | D8/376 |
| 0,185,374 | A | 12/1876 | Whitehouse | |
| 328,905 | A * | 10/1885 | Strasser et al. | 160/384 |
| D22,250 | S * | 2/1893 | Harsha | D8/376 |
| D22,271 | S * | 3/1893 | Ruxton | D8/376 |
| 1,810,885 | A | 6/1931 | Neuberth | |
| 1,839,919 | A | 1/1932 | Hall | |
| 1,928,009 | A | 9/1933 | Domier | |
| 1,963,057 | A | 6/1934 | Wilcox | |
| 2,237,969 | A | 4/1941 | Olsen | |
| 3,697,069 | A | 10/1972 | Merola | |
| 3,702,702 | A | 11/1972 | Hoult | |
| 3,972,529 | A | 8/1976 | McNeil | |
| 4,037,841 | A | 7/1977 | Lewis, Jr. | |
| D245,756 | S * | 9/1977 | McKee | D8/376 |
| 4,206,918 | A * | 6/1980 | Lewis, Jr. | 473/513 |
| 4,233,834 | A | 11/1980 | Matinlassi | |
| 4,280,727 | A | 7/1981 | Germain | |
| 4,445,354 | A | 5/1984 | Pfeiffer et al. | |
| 4,739,994 | A | 4/1988 | Lewis, Jr. | |
| 5,048,843 | A | 9/1991 | Dorfi et al. | |
| 5,651,744 | A | 7/1997 | Millon et al. | |
| 5,749,798 | A | 5/1998 | Kuebler et al. | |

(Continued)

OTHER PUBLICATIONS

TI22, Lacrosse Handle—Brine.

(Continued)

*Primary Examiner*—Eugene Kim
*Assistant Examiner*—M. Chambers
(74) *Attorney, Agent, or Firm*—Dickinson Wright PLLC

(57) ABSTRACT

A lacrosse handle having two sidewalls each with a channel and two arched walls extending between the sidewalls is disclosed herein. The channels contribute to increased gripping ability by the user and overall increased strength of the handle. Each channel is capable of receiving an insert that includes individualized information, for example, a school name or colors. Further, one of the arched walls may have a textured surface and the other arched wall may have a smooth surface to provide the user with a more accurate handle to head orientation than conventional lacrosse handles.

12 Claims, 1 Drawing Sheet

U.S. PATENT DOCUMENTS

| | | | | |
|---|---|---|---|---|
| 5,951,078 | A | 9/1999 | Whitehead et al. | |
| 6,235,134 | B1 | 5/2001 | Mueller | |
| 6,500,079 | B1 * | 12/2002 | Tucker, Sr. | 473/513 |
| 6,723,134 | B2 | 4/2004 | Tucker, Sr. | |
| 6,752,730 | B1 * | 6/2004 | Brine et al. | 473/513 |
| 6,889,405 | B2 | 5/2005 | Ritrovato et al. | |

OTHER PUBLICATIONS

IGNITE, Lacrosse Handle—Brine.
Ignite Supra, Lacrosse Handle—Brine.
Triax, Lacrosse Handle—DeBeer.
CPSC Web Page, Jun. 1997, web page downloaded May 11, 2005, www.cpsc.gov/cpscpub/prerel/prhtml97/97142.html, 1 page.
STX Lacrosse 2003 Equipment Apparel Catalog, 2 pages.
Brine 2000 Men and Women Catalog, 4 pages.

* cited by examiner

LACROSSE HANDLE

CROSS-REFERENCED TO RELATED APPLICATIONS

The present invention claims priority from U.S. Provisional Application Ser. No. 60/578,488, filed Jun. 10, 2004, and entitled "Flower Shaped Handle."

TECHNICAL FIELD

The present invention generally relates to the handle portion of a lacrosse stick for use by participants in the sport or game of lacrosse. The present invention, more particularly, relates to a lacrosse handle that has increased impact strength, allows for increased shooting accuracy and allows for a better grip than conventional lacrosse handles.

BACKGROUND OF THE INVENTION

Original lacrosse handles were constructed of wood. These wooden handles were shaped such that the lacrosse handle and lacrosse head were a single one-piece wood structure. These one-piece wooden lacrosse handles suffered from a variety of disadvantages. Initially, they were susceptible to damage from excess exposure to water. Further, these prior wooden handles were heavy and somewhat cumbersome. Additionally, the wooden handles were also susceptible to breakage. Moreover, because the wood had to be bent to form the single sidewall and the scoop, a significant amount of time was involved in forming or making each of these wooden lacrosse sticks. Accordingly, if any portion of the head or the handle broke or was damaged, the entire wooden stick needed to be replaced, which was a costly endeavor.

Subsequently, plastic lacrosse heads were developed. Thus, the lacrosse heads and the lacrosse handles were separate components that could be manufactured individually. Moreover, if either the lacrosse handle or the lacrosse head was damaged or broken, each of these components could be individually replaced.

Thereafter, metal lacrosse handles were developed for engagement with the plastic lacrosse heads. The initial metal handles were relatively heavy, which provided disadvantages from both a playability standpoint as well as from a safety standpoint. These lacrosse handles were constructed of a durable metal, such as aluminum. While these aluminum handles were acceptable from a strength standpoint and are still commonly used today, they are susceptible to damage from external forces. It is known that lacrosse is a fast-paced, high-contact sport and that the lacrosse handles can be subjected to large forces during play, such as when contacted by another stick. Lacrosse handles are most commonly subjected to external forces when a player is checked by an opponent's stick in an attempt to dislodge the lacrosse ball from the head. Further, if the external force is great enough, the stick can even break. Players, therefore, desire stronger and more durable handles with increased impact strength.

Therefore, a need exists for a lacrosse handle that has increased strength and durability and provides increased resistance to damage from external forces. It would also be desirable to provide a handle or stick with these characteristics that does not significantly add to the weight of the stick.

Accordingly, titanium handles were introduced that provided increased strength and resistance to damage from external forces. However, both the titanium and aluminum handles are still susceptible to damage. The damage can be in the from of dents or dings which will typically cause the stick to look worn or used. This is an undesirable feature for many players and can require a player to prematurely replace the handle or render a handle unplayable. Additionally, players seek a lacrosse stick that has an obvious head to handle orientation so that they can very quickly determine the proper grip on their handle. Finally, accuracy is another key element during the play of a lacrosse game. Therefore, players seek a very precise handle having a particular flex characteristic that increases accuracy when shooting the ball.

SUMMARY OF THE INVENTION

It is therefore an advantage of the present invention to provide a lacrosse handle that is stronger and more durable than existing lacrosse handles.

It is another advantage of the present invention to provide a lacrosse handle that has increased impact strength as compared to prior lacrosse handles.

It is still another advantage of the present invention to provide a lacrosse handle that gives a player feedback as to the orientation of a lacrosse head attached to the lacrosse handle based solely on how the player grips the handle.

It is yet another advantage of the present invention to provide a lacrosse handle that provides increased accuracy when shooting or passing a lacrosse ball.

It is a related advantage of the present invention to provide a lacrosse handle with flex characteristics that allow for increased shooting accuracy.

It is a further advantage of the present invention to provide a lacrosse handle with a unique cross-section that allows for better grip, which also results in more accurate control of the ball.

It is yet a further advantage of the present invention to provide a handle with a unique cross-section that provides tactile feedback as to the orientation of an attached lacrosse head during play.

In accordance with the above and the other advantages of the present invention, the present invention discloses an elongated handle for attachment to a lacrosse head. The handle includes a first side having a first channel, a second side having a second channel, a first end wall and a second end wall. The first side also includes a first edge and a second edge. Similarly, the second side includes a first edge and a second edge. The first end wall extends between the first edge of the first side and the first edge of the second side. The second end wall extends between the second edge of the first side and the second edge of the second side. The resultant handle has improved strength and resistance to impact.

BRIEF DESCRIPTION OF THE DRAWINGS

The present invention will be described by way of example with reference to the following drawings.

DETAILED DESCRIPTION OF THE PREFERRED EMBODIMENT

Figure 2:
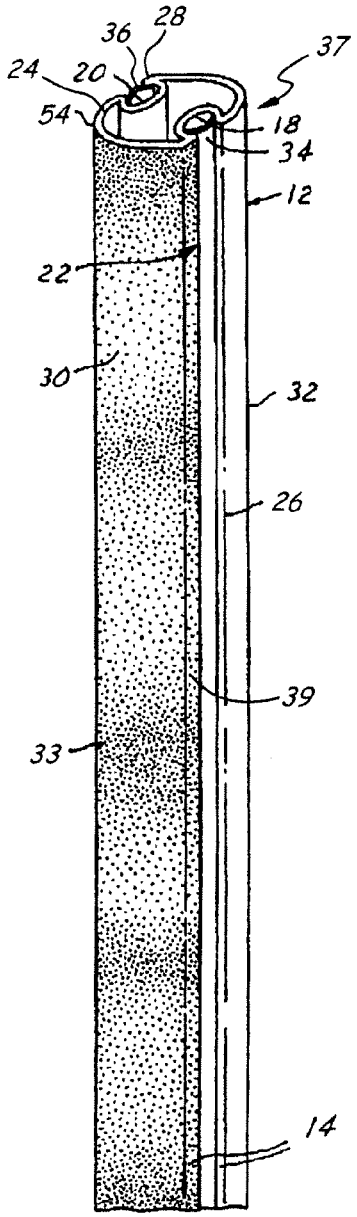
FIG. 2 illustrates a perspective view of a lacrosse handle in accordance with the preferred embodiment of the present invention.
Figure 3:
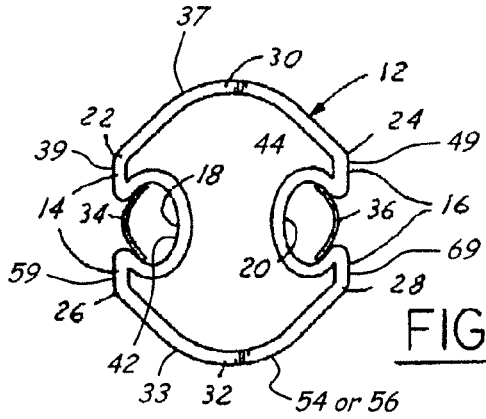
FIG. 3 illustrates a cross-sectional view of the lacrosse handle of FIG. 2.
Figure 1:
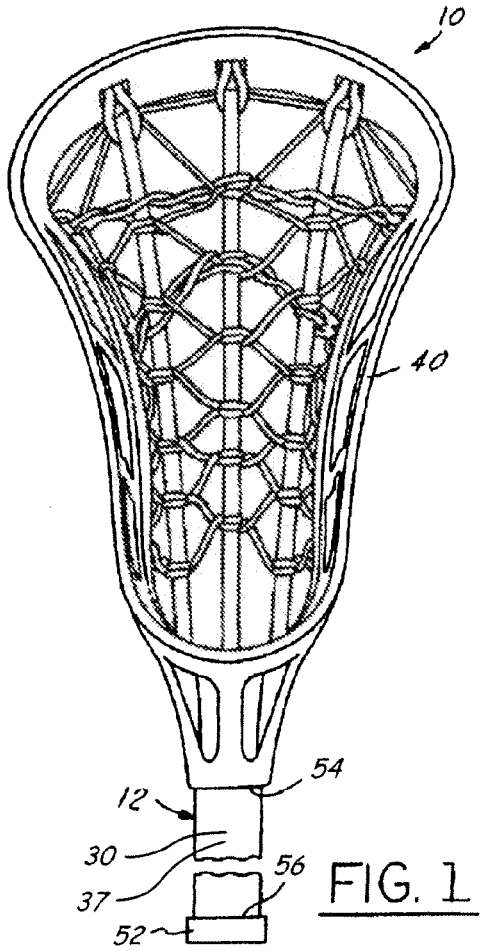
FIG. 1 illustrates a front view of a lacrosse handle with an attached lacrosse head in accordance with a preferred embodiment of the present invention.

Referring to FIGS. 1-3, the lacrosse stick of the present invention is generally referred to as reference number 10 and includes an elongated handle 12 that attaches to a lacrosse head 40. In one embodiment, the handle 12 is generally hollow and is constructed of a metallic material, such as aluminum or titanium. It will be understood that the handle 12 can take on a variety of other configurations, i.e. solid or partially solid. Further, the handle 12 can be formed of a variety of other suitable materials, such as graphite, other composite materials, or plastic. The handle 12 has a first side or sidewall 14 and a second side or sidewall 16.

Each of the sidewalls 14, 16 includes a respective channel 18, 20. Further, each sidewall 14, 16 has a first edge 22, 24 located at an upper edge of the respective channel 18, 20, and a second edge 26, 28 located at a lower edge of the respective channel 18, 20. A first end wall 30 extends between and connects the first edge 22 of the first sidewall 14 and the first edge 24 of the second sidewall 16. Similarly, there is a second end wall 32 that extends between the second edge 26 of the first sidewall 14 and the second edge 28 of the second sidewall 16. The end wall walls 30, 32 are preferably oriented such that they are arched and bow out or curve away from each other and the sidewalls to which they connect. It will be understood by one of ordinary skill in the art that the walls 30, 32 can take on a variety of different configurations as desired.

Each of the channels 18, 20 preferably is set back with respect to the respective sidewall 14, 16 in which it is formed. The channels 18, 20 preferably extend along the length of the handle. However, the channels 18, 20 may extend along less than all of the entire length as desired. Each channel 18, 20 includes a bottom channel wall 42, 44. The bottom channel wall 42 extends between and connects the first edge 22 and the second edge 26 of the first sidewall 14. The bottom channel wall 44 extends between and connects the first edge 24 and the second edge 28 of the second sidewall 16. The bottom channel walls 42, 44 are preferably curved, but may alternatively take on a variety of different configurations. Because the bottom channel walls 42, 44 are disposed inwardly or set back with respect to the sidewalls 14, 16 they provide increase strength and impact resistance to the handle 12, particularly from contact to either end wall 30, 32 of the handle 12. Further, this channel configuration allows the handle to flex due to their set back configuration which provides a handle with more whip.

Each of the end walls 30, 32 has an exterior surface. In one embodiment, the exterior surface of the end wall 30 is textured, as generally represented by reference number 33 while the exterior surface of the end wall 32 has a smooth surface as generally represented by reference numeral 37. The end wall 30. as shown in FIG. 1, is illustrated as the upper wall, while the end wall 32 is illustrated as the lower wall. However, it will be understood that this is for purposes of illustration only and that the end walls 30, 32 may be oriented such that either may be disposed as the top surface or the bottom surface of the handle 12.

Further, the textured surface extends between a portion of the first sidewall 14 and a portion of the second sidewall 16. Specifically, referring to the first sidewall 14, the area 39 between the first sidewall 14 first edge 22 to the first channel 18 is also preferably textured. Similarly, the area 49 on the second sidewall 16 between the first edge 24 and the second channel 20 is also textured. It will also be understood that the texture may extend along the end wall 30 along the entire length of the handle. Alternatively, the texture may instead be disposed over only a substantial part of the end wall 30. Further, the texture may be located on the end wall 30 at only select locations along the length of the handle 12, such as in locations where a player's hands typically contact a lacrosse handle during play. One of ordinary skill in the art will understand these locations. Similarly, the texture may extend over the entire length or only a portion of the first sidewall 14 and/or the second sidewall 16.

The smooth surface also extends between and connects a portion of the first sidewall 14 and a portion of the second sidewall 16. The area 59 between the second edge 26 of the first sidewall 14 and the first channel 18 is preferably smooth and the area 69 between the second edge 28 and the second sidewall 16 to the second channel 20 is smooth. In other words, half of the first sidewall 14 is smooth and half of the first sidewall 14 is textured. Similarly, half of the second sidewall 16 is smooth and half of the second sidewall 16 is textured. It will be understood that instead of a texture, a surface structure can be located on one side of the handle. Other textured surface to smooth surface configurations may be utilized.

Since half of the handle 12 is textured and the other half is smooth, the user or player has a much better handle to head orientation during play. Moreover, a texture on one side or half of the handle provides a player with a better grip on the stick for improved ball handling as well and improved shooting and passing accuracy. In other words, depending upon where or how the texture contacts the player's hands, it provides the player with tactile feedback as to the orientation of the attached head. One method of adding texture to the textured area is through sand blasting. However, a variety of other methods for forming the textured surface may be utilized.

The player can decide how to position the textured surface relative to the lacrosse head. For instance, in FIG. 1, the smooth surface 37 is shown positioned adjacent to the front face of the lacrosse head 40. It should be understood that the textured surface 33 could be positioned adjacent to the front face of the lacrosse head 40.

Both channels 18, 20 along each of the sidewalls 14, 16 serve multiple purposes. One purpose is to provide an additional gripping surface on the handle 12. Another purpose is to receive an insert 34, 36. The inserts 34, 36 might be long, thin strips of plastic. Further, the inserts 34, 36 may extend the whole length of the channel. However, it will be understood that the inserts 34, 36 may instead extend along only a portion of the channels 18, 20. In one embodiment, the inserts 34, 36 can have writing or include color and are for purposes of aesthetics. Some examples include, but are not limited to, the name of the handle manufacturer, the name of the player's team, or a team's colors. The inserts are preferably releaseably engageable with each channel 18, 20. Still another purpose is to provide a handle with increased flex.

Referring to FIG. 2, first insert 34 is shown located within the first channel 18 and the second insert 36 is shown located within the second channel 20. Although a total of two inserts are shown with, one in each channel, it is to be understood that there could be only one insert used in one of the channels while the other channel is left empty. Further, multiple inserts can be disposed in each channel at a given time.

The handle 12 has a first distal end 54 and a second distal end 56. The lacrosse head 40 is attached to the handle 12 at its first distal end 54 and an end cap 52 is attached to the handle 12 at the second distal end 56.

While the present invention has been described in what is presently considered to be its most practical and preferred embodiment or implementation, it is to be understood that the invention is not to be limited to the disclosed embodiment. On the contrary, the present invention is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An elongate handle for attachment to a lacrosse head comprising:

a first sidewall having a first edge, a second edge, a first area, a second area, and a first channel, said first area between said first edge and said first channel and said second area located between said second edge and said first channel;

a second sidewall having a first edge, a second edge, a first area, a second area, and a second channel, said first area between said first edge and said second channel and said second area located between said second edge and said second channel;

a first end wall extending between said first edge of said first sidewall and said first edge of said second sidewall; and a second end wall extending between said second edge of said first sidewall and said second edge of said second sidewall wherein said first end wall and said second end wall bow out away from each other; wherein only one of either said first end wall exterior surface or said second end wall exterior surface has a textured surface and the other of said first end wall exterior surface or said second end wall exterior surface has a smooth surface and further comprising an insert received within said first channel.

2. The elongate handle of claim 1, wherein said first and second end walls each has an exterior surface.

3. The elongate handle of claim 1, further comprising a second insert received within said second channel.

4. The elongate handle of claim 3, wherein said insert and said second insert are made from plastic.

5. The elongate handle of claim 1, wherein said handle is metallic.

6. The elongate handle of claim 1, further comprising a first distal end, a second distal end, and a lacrosse head attached to said first distal end.

7. The elongate handle of claim 1, wherein an exterior surface of said first sidewall is textured between said first sidewall first edge and said first channel.

8. A hollow elongate handle for attachment to a lacrosse head comprising:

a first sidewall having a first edge, a second edge, a first area, a second area, and a first channel, said first area between said first edge and said first channel and said second area located between said second edge and said first channel;

a second sidewall having a first edge, a second edge, a first area, a second area, and a second channel, said first area between said first edge and said second channel and said second area located between said second edge and said second channel;

a first end wall extending between said first edge of said first sidewall and said first edge of said second sidewall, said first end wall having an exterior surface;

a second end wall extending between said second edge of said first sidewall and said second edge of said second sidewall, said second end wall having an exterior surface; and wherein only one of either said first end wall exterior surface or said second end wall exterior surface has a textured surface and the other of said first end wall exterior surface or said second end wall exterior surface has a smooth surface and wherein an insert is received within said first channel.

9. The elongate handle of claim 8, further comprising a second insert received within said second channel.

10. The elongate handle of claim 9, wherein said insert and said second insert are made from plastic.

11. The elongate handle of claim 8, wherein said handle is metallic.

12. The elongate handle of claim 11, wherein said handle is made from aluminum.

* * * * *